US008454194B2

(12) United States Patent
Liu

(10) Patent No.: US 8,454,194 B2
(45) Date of Patent: Jun. 4, 2013

(54) LIGHT EMITTING DIODE LAMP

(75) Inventor: Tay-Jian Liu, Tu-Cheng (TW)

(73) Assignee: Foxconn Technology Co., Ltd., New Taipei (TW)

( * ) Notice: Subject to any disclaimer, the term of this patent is extended or adjusted under 35 U.S.C. 154(b) by 213 days.

(21) Appl. No.: 13/116,022

(22) Filed: May 26, 2011

(65) Prior Publication Data

US 2012/0099318 A1 Apr. 26, 2012

(30) Foreign Application Priority Data

Oct. 20, 2010 (CN) ..... 2010 1 0512899

(51) Int. Cl.
*F21S 4/00* (2006.01)
*F21V 29/00* (2006.01)
*F21V 21/00* (2006.01)

(52) U.S. Cl.
USPC ..... 362/218; 362/219; 362/221; 362/294; 362/580; 362/249.02

(58) Field of Classification Search
USPC ..... 362/218, 219, 221, 249.02, 294, 362/545, 547–549, 580; 313/49
See application file for complete search history.

(56) References Cited

U.S. PATENT DOCUMENTS

| | | | | |
|---|---|---|---|---|
| 7,918,580 | B2 * | 4/2011 | Liu | 362/218 |
| 7,926,982 | B2 * | 4/2011 | Liu | 362/294 |
| 2010/0172133 | A1 * | 7/2010 | Liu | 362/235 |

* cited by examiner

*Primary Examiner* — Karabi Guharay
(74) *Attorney, Agent, or Firm* — Altis Law Group, Inc.

(57) ABSTRACT

A light emitting diode lamp includes a lamp base defined a plurality of openings and a number of illumination modules located on the lamp base. Each illumination module includes a number of lamp holders separately located on sidewalls of the openings and a number of illumination units held by the lamp holders and apart from each other. Each illumination unit includes a hollow heat dissipating assembly, at least one lighting assembly contacting the hollow heat dissipating assembly, at least one printed circuit board, and two connection units connected to two opposite terminals of the hollow heat dissipating assembly. The printed circuit board controls a power supply through the lamp holders and at least one of the connection units to the lighting assembly.

18 Claims, 12 Drawing Sheets

LIGHT EMITTING DIODE LAMP

BACKGROUND

1. Technical Field

The present disclosure relates to a light emitting diode (LED) lamp, and particularly, to an illumination module of an LED lamp.

2. Description of Related Art

LEDs have many advantages, such as high luminosity, low operational voltage, low power consumption, easy driving, long-term reliability, environmental friendliness for not having to use mercury (Hg), and high impact resistance, which have led to LEDs being widely used as light sources.

Radiant efficiency and lifespan of the LEDs may be distinctly reduced by high working temperatures if an LED illumination device does not include a highly efficient heat dissipating assembly.

Large LED illumination devices, such as streetlights, spotlights, and searchlights, include a base, a heat dissipating assembly defining a number of fins on one side of the base, an LED light source mounted on the base opposite to the heat dissipating assembly, a housing enclosing the LED light source, and a driving power source to drive the LED light source. However, the heavy weight and huge volume of the heat dissipating assembly cause a lot of work and cost for configuration, disassembly, and repair, especially for hanging illumination devices, such as streetlights.

In addition, because of various illumination applications and customer needs, different kinds of illumination devices are designed having quite different structures, since one illumination device usually cannot be adopted to different illumination applications. As such, design, development, and manufacture of the LED illumination devices are costly.

Accordingly, it is desirable to provide an LED lamp which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the disclosure are now described in detail with reference to the accompanying drawings.

Figure 1:
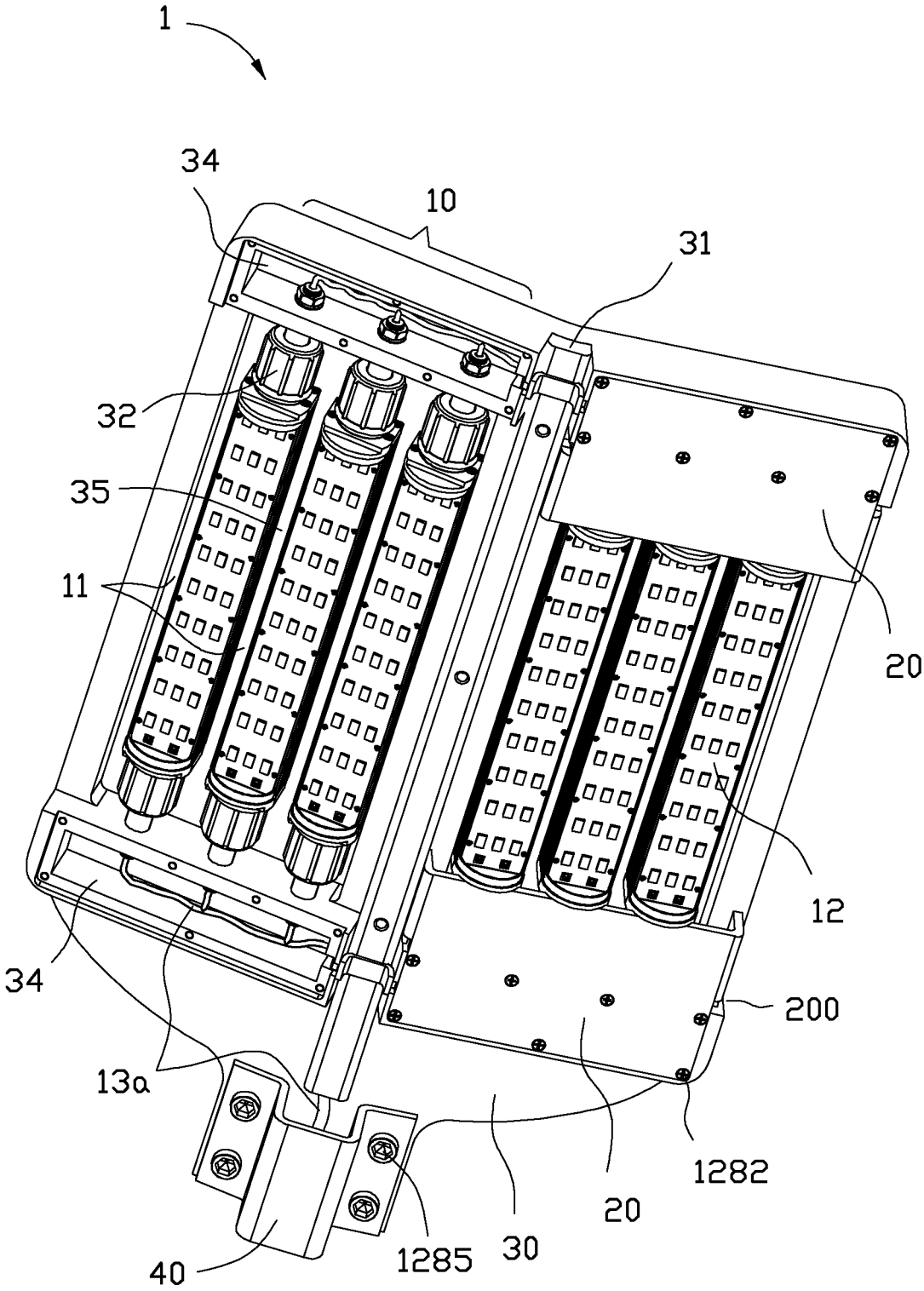
FIG. 1 is a perspective view of a part of an LED lamp according to a first embodiment of the present disclosure, in which two mounting plates are removed.
Figure 2:
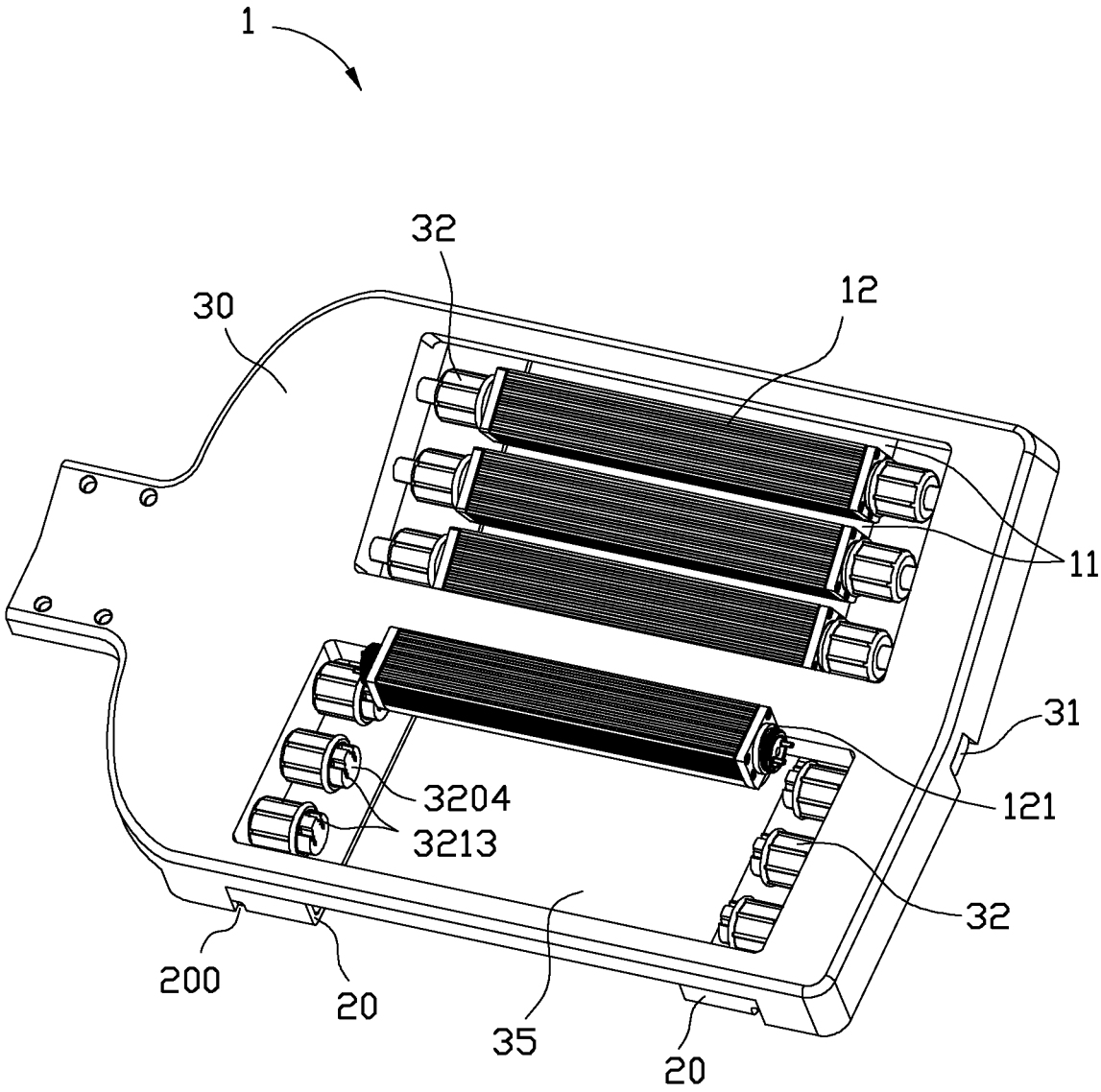
FIG. 2 is similar to FIG. 1, but viewed from another aspect, in which two illumination units are removed.

Referring to FIG. 1 and FIG. 2, an LED lamp 1 in accordance with the present disclosure includes two illumination modules 10, a number of power cords 13*a*, a wire housing 31, a lamp base 30, and a pole connection unit 40. The LED lamp 1 is, for example, a streetlight.

The pole connection unit 40 is fixed to the lamp base 30 by four screws 1285, and can be connected to a pole or other support (not shown). The lamp base 30 defines two openings 35 corresponding to the two illumination modules 10, and four wire chutes 34 located at terminals of the two illumination modules 10. The wire housing 31 is located on the lamp base 30 and between the two illumination modules 10 to accommodate the power cords 13*a*. The power cords 13*a* accommodated in the same wire chute 34 are electrically connected to the same polarity, and the power cords 13*a* connected to the opposite terminals of the illumination modules 10 are electrically connected to currents with different polarities, so currents flow easily from p-type material to n-type material in LEDs. The wire housing 31 can prettify the LED lamp 1, and weatherproof the power cords 13*a*. The lamp base 30 may be a planar frame, a curved frame, or consisted of a number of planar frames at an angle to each other. In this embodiment, the lamp base 30 is substantially symmetrical to a central line thereof, and includes two planar frames located on two opposite sides of the central line at an angle to each other. As such, illumination distribution of the LED lamp 1 is broader than a planar lamp.

Each illumination module 10 includes three illumination units 12, three pairs of lamp holders 32 located between the illumination units 12 and two wire chutes 34, two mounting plates 20 respectively covering the two wire chutes 34 (two mounting plates 20 located at the left side are removed for showing the wire chutes 34 and lamp holders 32), and fourteen screws 1282 penetrating the mounting plates 20 and threadedly engaging with the wire chute 34 of the lamp base 30 thereby securing the mounting plates 20 to the lamp base 30.

The lamp holders 32 are electrical and mechanical connection units. The illumination units 12 are fixed to the lamp base 30 by the lamp holders 32, and are apart from each other. Accordingly, the illumination units 12 define gaps 11 therebetween to enhance natural convection, and to reduce weight of the LED lamp 1. The gaps 11 allow wind, snow, rainwater and dust to pass through, so as to prevent possible load caused by these foreign matter on the LED lamp 1.

The mounting plates 20 substantially has a U-shape in side view. The mounting plates 20 can hermetically seal the wire chutes 34, and cover both the wire chutes 34 and the lamp holders 32. The mounting plates 20 not only prettify the LED lamp 1, but also support the illumination modules 10. The LED lamp 1 further defines four drainage pipelines 200 between the mounting plates 20 and the wire chutes 34. The drainage pipelines 200 are located at lower positions of the LED lamp 1 to drain water from the LED lamp 1. Since an inclination angle of streetlight is usually about 15 degrees from the horizontal, the rainwater falling on the LED lamp 1 can easily flow out through the drainage pipelines 200.

Figure 3:
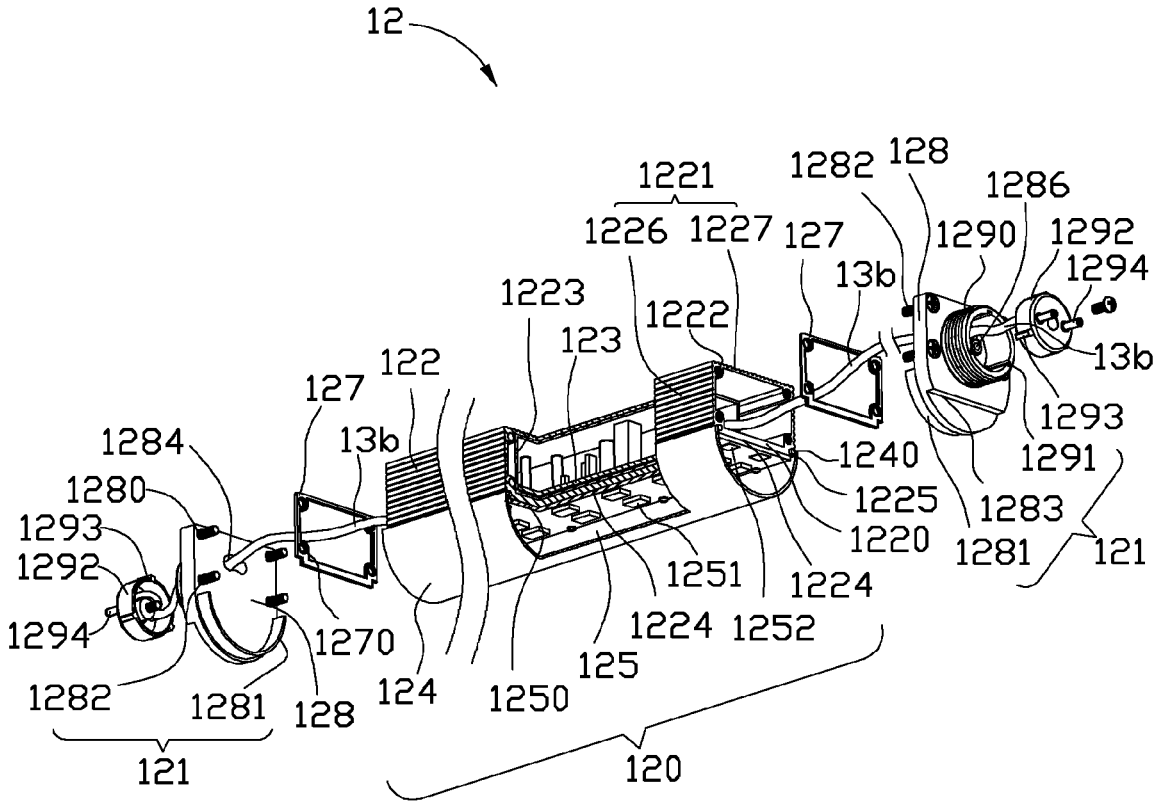
FIG. 3 shows a partially exploded view of an illumination unit of FIG. 1.

As shown in FIG. 3, each illumination unit 12 is relatively long and narrow. Each illumination unit 12 includes a long lamp module 120, two connection units 121 connected to two opposite terminals of the lamp module 120, and two power cords 13*b* penetrating the lamp module 120 and the connection units 121. Each lamp module 120 includes a long, hollow, heat dissipating assembly 122, at least one lighting assembly 125, at least one printed circuit board 123, and a long light guide housing 124.

The heat dissipating assembly 122 is made of thermally conductive material, such as metal. The heat dissipating assembly 122 includes a heat dissipating base 1220 and a heat dissipating case 1221, which together define a hollow rectangular space therein. Located corresponding to each of the opposite terminals of the lamp module 120, the heat dissipating case 1221 further defines four screw holes 1222 at four corners thereof. The heat dissipating assembly 122 provides physical protection and heat-conduction to ensure the reliability of the illumination units 12. The metal wall of the heat dissipating assembly 122 provides electromagnetic shielding to protect the circuits and elements therein.

The heat dissipating base 1220 is substantially a plate. The outer surface of the heat dissipating base 1220 is an endothermic surface 1224 contacting the lighting assembly 125. The heat dissipating base 1220 defines two grooves 1225 respectively located on two opposite side surfaces thereof. Two terminal flanges 1240 of the light guide housing 124 are received in the two grooves 1225. As such, the heat dissipating base 1220 can seal a top opening of the light guide housing 124.

The heat dissipating case 1221 includes two sidewalls 1226 and a top plate 1227. The top plate 1227 is parallel to the heat dissipating base 1220, and is apart from the heat dissipating base 1220. The two sidewalls 1226 are located on two opposite edges of the top plate 1227, and extend from the top plate 1227 down to the heat dissipating base 1220. The sidewalls 1226 and the top plate 1227 include heat-dissipating structures on the outer surfaces thereof, such as narrow fins shown in FIG. 3, to improve heat dissipation. It is noted that the heat-dissipating structures are not limited to the shown embodiment, and may include any appropriate shapes, such as columns or wide fins.

The lighting assembly 125 is located under the hollow heat dissipating assembly 122. The lighting assembly 125 includes a light source base 1250, a number of LED elements 1251 located on the light source base 1250, and a number of electrodes 1252. The electrodes 1252 are formed on a lower surface of the light source base 1250, and are electrically connected to the LED elements 1251. Each LED element 1251 may include at least one LED chip sealed by a transparent material. The light source base 1250 of the lighting assembly 125 contacts the endothermic surface 1224 of the heat dissipating base 1220. The heat dissipating base 1220 may include a thermal interface material (TIM, not labeled) coated between the light source base 1250 and the endothermic surface 1224. The light source base 1250 may be tightly fixed to the heat dissipating base 1220 by screws. The heat produced from the LED elements 1251 can be effectively transferred from the lighting assembly 125 to the nearby heat dissipating case 1221. The temperature difference between the illumination units 12 and the surroundings causes natural convection in the gaps 11, and the large outer surface of the heat dissipating assembly 122 and the gaps 11 make the natural convection more active.

The printed circuit board 123 is located in the hollow space defined by the heat dissipating assembly 122. The power cord 13*b* is electrically connected to the electrode (not shown) of the printed circuit board 123. The printed circuit board 123 transmits driving current to the lighting assembly 125, and controls the power supplied to the LED elements 1251. Since the hollow heat dissipating assembly 122 is made of metal in this embodiment, the lamp module 120 further includes an electrically insulating sleeve 1223 located in the hollow heat dissipating assembly 122 to surround the printed circuit board 123. The sleeve 1223 electrically insulates the printed circuit board 123 from the hollow heat dissipating assembly 122. The sleeve 1223 can be made of thermally conductive material to enhance heat dissipation.

The light guide housing 124 is a transparent arc shaped housing covering the lighting assembly 125. The housing 124 includes two flanges 1240 respectively at two opposite edges corresponding to the two grooves 1225 of the heat dissipating base 1220. The two flanges 1240 are parallel to the extension direction of the lamp module 120. The two flanges 1240 extend inward and respectively insert into the two grooves 1225 of the heat dissipating base 1220. As such, the housing 124 is fixed to the heat dissipating base 1220. The housing 124 can adjust the illumination distribution of the LED lamp 1, and protect the lighting assembly 125. In other embodiments, each illumination unit 12 may further include lenses or reflective elements to enhance the optical performances of the LED elements 1251 of the LED lamp 1, for example, illumination distribution and brightness.

The two connection units 121 are located at two opposite terminals of the lamp module 120, and hermetically seal the lamp module 120. Each connection unit 121 includes a cover 128, a seal piece 127, five screws 1282 and a lamp plug 1292. Each cover 128 includes a location piece 1281, a stair portion 1283, a threaded neck 1290, three locking grooves 1291, four screw holes 1280 and a wire hole 1284.

The location pieces 1281 are inserted into the lamp module 120 and contact the inner surface of the housing 124. The four screw holes 1280 correspond to the four screw holes 1222. Each seal piece 127 is located between the corresponding cover 128 and the lamp module 120. Each seal piece 127 defines four screw holes 1270 corresponding to the four screw holes 1280 and the four screw holes 1222. For each connection unit 121, four of the screws 1282 penetrate the four screw holes 1280, the four screw holes 1270 and the four screw holes 1222, so the cover 128 and the seal piece 127 are fixed to the heat dissipating case 1221.

Each stair portion 1283 is located on the outer side of the corresponding cover 128 opposite to the lamp module 120. The stair portions 1283 can fittingly engage with the mounting plates 20 at opposite edges of the opening 35 of the lamp base 30 as shown in FIG. 2, to position each lamp module 120.

Each threaded neck 1290 is substantially a cylinder extending outwardly from the cover 128, and is parallel to the lamp module 120. Each threaded neck 1290 includes threads on an outer circumferential periphery thereof to threadedly engage with a corresponding lamp holder 32. Each lamp plug 1292 includes two contact pins 1294 on the outer surface opposite to the lamp module 120, and is parallel to the lamp module 120. The three locking grooves 1291 are located on an inner circumferential periphery of each threaded neck 1290; and each lamp plug 1292 includes three tenon bars 1293 for fittingly engaging in the three locking grooves 1291. The lamp plug 1292 inserts into the threaded neck 1290, and the three locking grooves 1291 fittingly receive the three tenon bars 1293. The locking grooves 1291 and the tenon bars 1293 help to orientate the lamp plug 1292 with the nearby cover 128, so a virtual plane passing through centers of the two contact pins 1294 is parallel to the heat dissipating base 1220. Accordingly, the lamp plug 1292 can smoothly insert into the lamp holder 32 of FIG. 1, and keep the illumination unit 12 at a predetermined orientation.

For each connection unit 121, one of the screws 1282 penetrates the lamp plug 1292 and threadedly engages in a screw hole 1286 on the center of the threaded neck 1290, so the lamp plug 1292 is fixed to the cover 128. Thus, the heat dissipating case 1221 is sealed to make the illumination units 12 waterproof. The contact pins 1294 are electrically connected to the power cord 13*b*.

Figure 4:
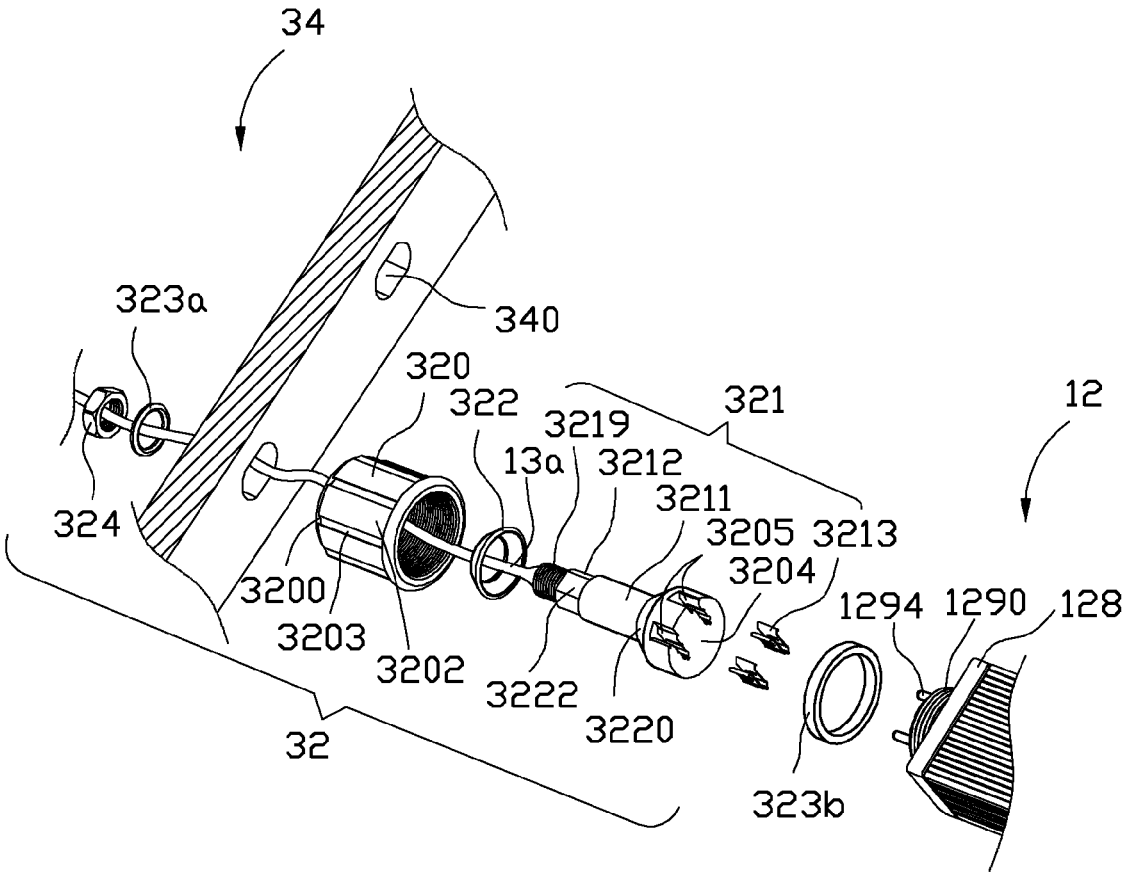
FIG. 4 is an exploded, isometric view of a lamp holder and a corresponding illumination unit of FIG. 1.

Referring to FIG. 4, the power cord 13*a* penetrates a location hole 340 defined by the wire chute 34, and is electrically connected to the corresponding lamp holder 32. Thus, the power cord 13*a* is electrically connected to the illumination unit 12 through the lamp holder 32 and the lamp plug 1292, and supplies electric power to the illumination unit 12.

The lamp holder 32 includes a holding base 320, a socket 321, a nut 324, and three seal rings 322, 323*a* and 323*b*. From the left to the right, the power cord 13*a* penetrates the nut 324, the seal ring 323*a*, the location hole 340, the holding base 320, and the seal ring 322, and inserts into the socket 321. The seal ring 323*b* surrounds the threaded neck 1290 of the illumination unit 12 and hermetically engages with the lamp holder 32.

Figure 5:
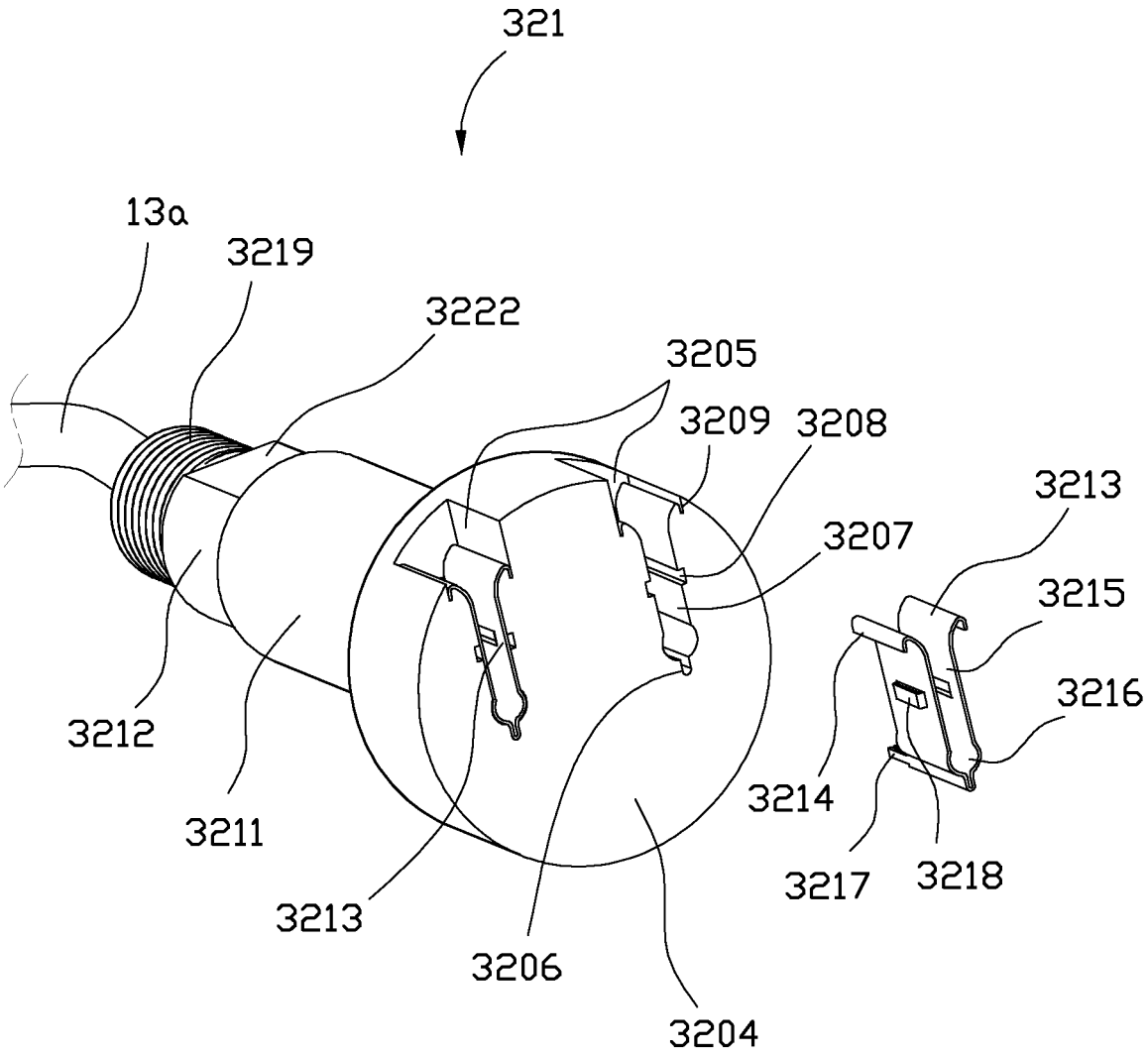
FIG. 5 is an enlarged, partially exploded view of a socket of FIG. 4.
Figure 6:
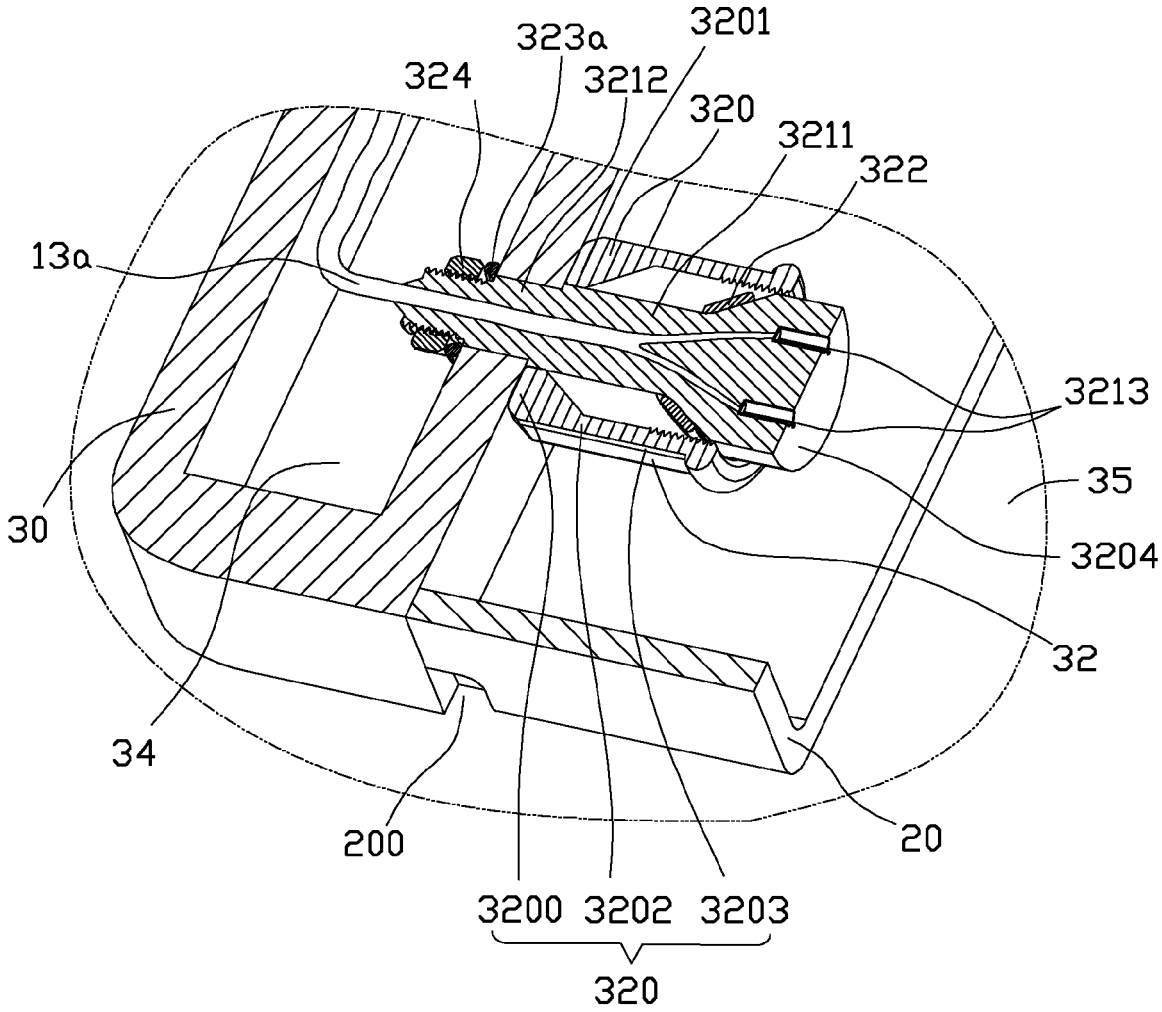
FIG. 6 is a cross sectional view of a part of a lamp holder of FIG. 1.

Referring to FIG. 4, FIG. 5 and FIG. 6, the socket 321 includes a socket base 3204, a neck portion 3211, an orientation portion 3212, two socket clips 3213 and a threaded portion 3219. The socket base 3204, the neck portion 3211, the orientation portion 3212 and the threaded portion 3219 are integrated as a single piece. The neck portion 3211 is located between the socket base 3204 and the orientation portion 3212. The orientation portion 3212 includes two planar surfaces 3222 parallel and opposite to each other (one of the planar surfaces 3222 is not shown in FIG. 4). The outer surfaces of the orientation portion 3212, including the two planar surfaces 3222, fittingly engage in the location hole 340 defined by the inner surfaces of the wire chute 34, so keeps the socket 321 arranged at a predetermined orientation. The threaded portion 3219 is located on one side of the orientation portion 3212 opposite to the neck portion 3211. The threaded portion 3219 includes threads on an outer circumferential periphery thereof to threadedly engage with the inner thread of the nut 324.

The socket base 3204 includes a cone surface 3220 connecting the neck portion 3211, and defines two slots 3205 corresponding to the contact pins 1294. A virtual plane passing through the centers of the two slots 3205 is parallel to the planar surfaces 3222. The two slots 3205 hold the two socket clips 3213 respectively.

As shown in FIG. 5, each slot 3205 includes a minor slit 3206 on the bottom, a major slit 3207 above the minor slit 3206, two locking grooves 3208 located on two opposite surfaces of a middle of the major slit 3207, and two hooked cavities 3209 on two opposite surfaces of a top of the major slit 3207. Each socket clip 3213 substantially includes a V-shaped spring, and has an outer surface corresponding to each slot 3205. From top to bottom, each socket clip 3213 defines two hooked fasteners 3214 for fittingly engaging in the two hooked cavities 3209, two sidewalls 3215 for fittingly engaging with the two side surfaces of the major slit 3207, two expansion portions 3216 to hold the two contact pins 1294 of FIG. 4, and a weld portion 3217 for fittingly engaging in the minor slit 3206. The weld portion 3217 protrudes toward the neck portion 3211, and is electrically connected to the power cord 13*a* penetrating into the slot 3205.

Each socket clip 3213 further defines two protrusions 3218 on the two sidewalls 3215 for engaging into the two locking grooves 3208. The socket clips 3213 can lodge in socket base 3204, so movement of the lamp plug 1292 will not cause the socket clips 3213 to separate from the socket base 3204. For each socket clip 3213, the minimum distance between the two sidewalls 3215 is less than the diameter of the contact pin 1294. Accordingly, the socket clips 3213 can clip the contact pins 1294, and keep the positions of the contact pins 1294. Each expansion portion 3216 has an inner surface fittingly engaging with the outer surface of the corresponding contact pin 1294, so to increase the contact area between the socket clip 3213 and the contact pin 1294.

Each holding base 320 defines a circular end ring 3200 and a sidewall 3202. The circular end ring 3200 defines a hole 3201 in the center to hold the neck portion 3211, as shown in FIG. 6. The sidewall 3202 surrounds the circular end ring 3200, and is connected to the outer edge of the circular end ring 3200. The sidewall 3202 includes threads on the inner surface to threadedly engage with the threads on the outer surface of the threaded neck 1290. As shown in both FIG. 4 and FIG. 6, the sidewall 3202 of each holding base 320 further defines a number of grooves 3203. Each groove 3203 is arranged parallel to the axial direction of the holding base 320 for the convenience of rotating the holding base 320.

The lamp holder 32 can be easily assembled without tools before the whole LED lamp 1 is assembled on the street, as shown in FIG. 6. Assembly of the lamp holder 32 includes threading through the seal rings 322 and the holding base 320 with the power cord 13*a* connecting to the socket 321, pushing the seal ring 322 and the holding base 320 to the neck portion 3211, threading through the location hole 340 of the wire chute 34 with the power cord 13*a* connecting to the socket 321, pushing the orientation portion 3212 to fit in the location hole 340, threading through the seal ring 323*a* and the nut 324 inside the wire chute 34, and screwing the nut 324 to the threaded portion 3219. Accordingly, the seal ring 323*a* seals the location hole 340, and the lamp holder 32 is tightly fixed to the wire chute 34. The lamp holder 32 can also be easily disassembled without tools through an operation in reverse order of the above mentioned operation.

The illumination unit 12 can also be easily assembled and disassembled without tools. Referring to FIG. 4, assembly of an illumination unit 12 includes pushing two holding bases 320 (only one is shown in FIG. 4) respectively toward two wire chutes 34 to ensure that the socket clips 3213 are exposed, providing two seal rings 323*b* to respectively surround two threaded necks 1290 and contact the covers 128, pushing the contact pins 1294 of the lamp plugs 1292 into the expansion portions 3216 from top of the socket clips 3213, pushing the two holding bases 320 respectively toward the two threaded necks 1290, and screwing the two holding bases 320 respectively onto the two threaded necks 1290. The seal rings 322 accordingly contact the cone surfaces 3220 of the socket bases 2304. Disassembly of the illumination unit 12 is performed through an operation in reverse order of the above mentioned operation.

Accordingly, the illumination modules 10 and the illumination units 12 of the present disclosure can be produced in batches, and numbers and arrangements of the illumination modules 10 and the illumination units 12 can be easily adjusted. Since the LED lamp 1 is formed by the modularized illumination modules 10 and illumination units 12, the LED lamp 1 can be easily modified for various applications. In addition, the connection units 121 enable easier manual repair of the suspended LED lamp. Repairmen can quickly replace the illuminating unit 12 without tools.

Figure 7:
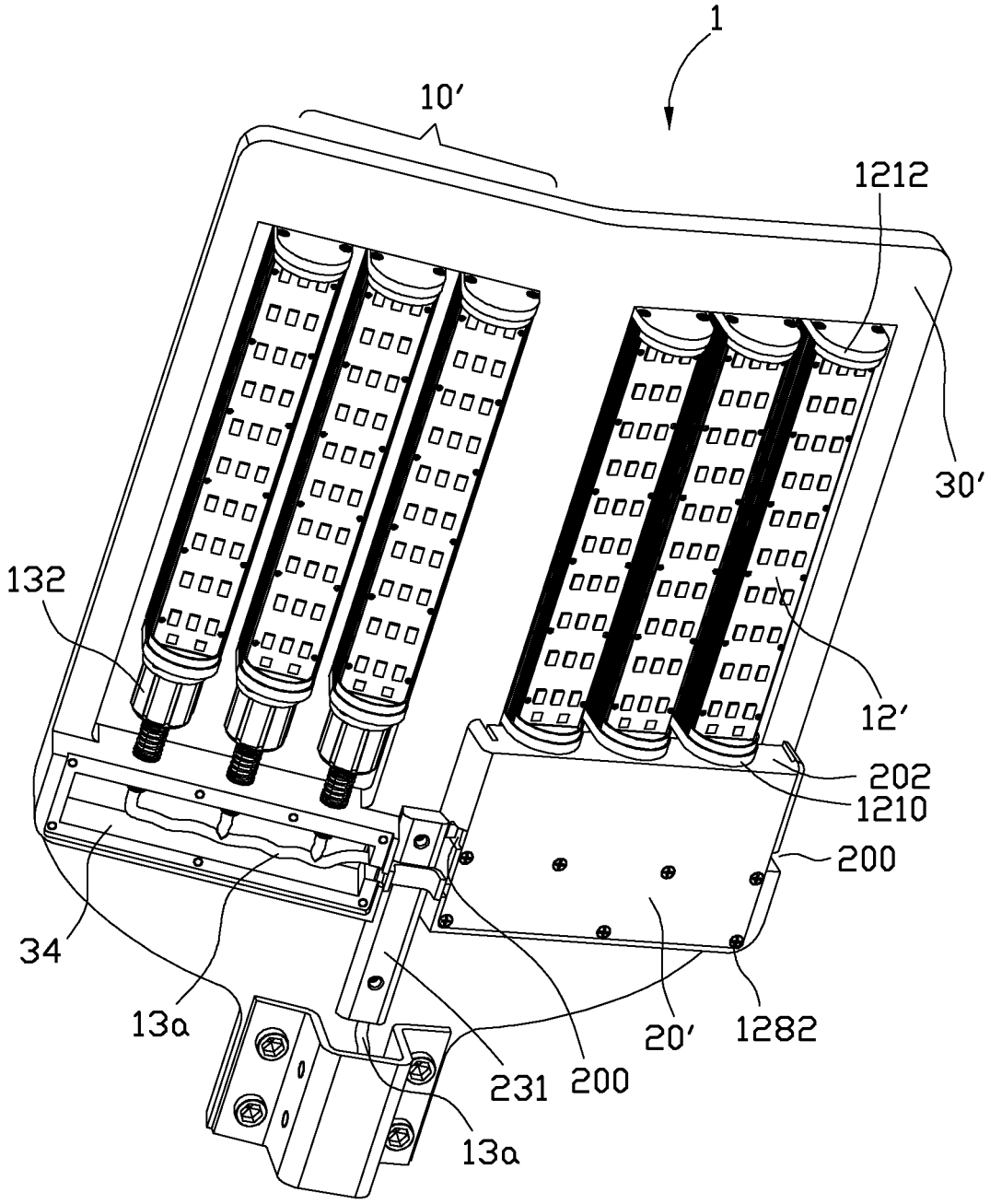
FIG. 7 is a perspective view of a part of an LED lamp according to a second embodiment of the present disclosure, in which one mounting plate is removed.
Figure 8:
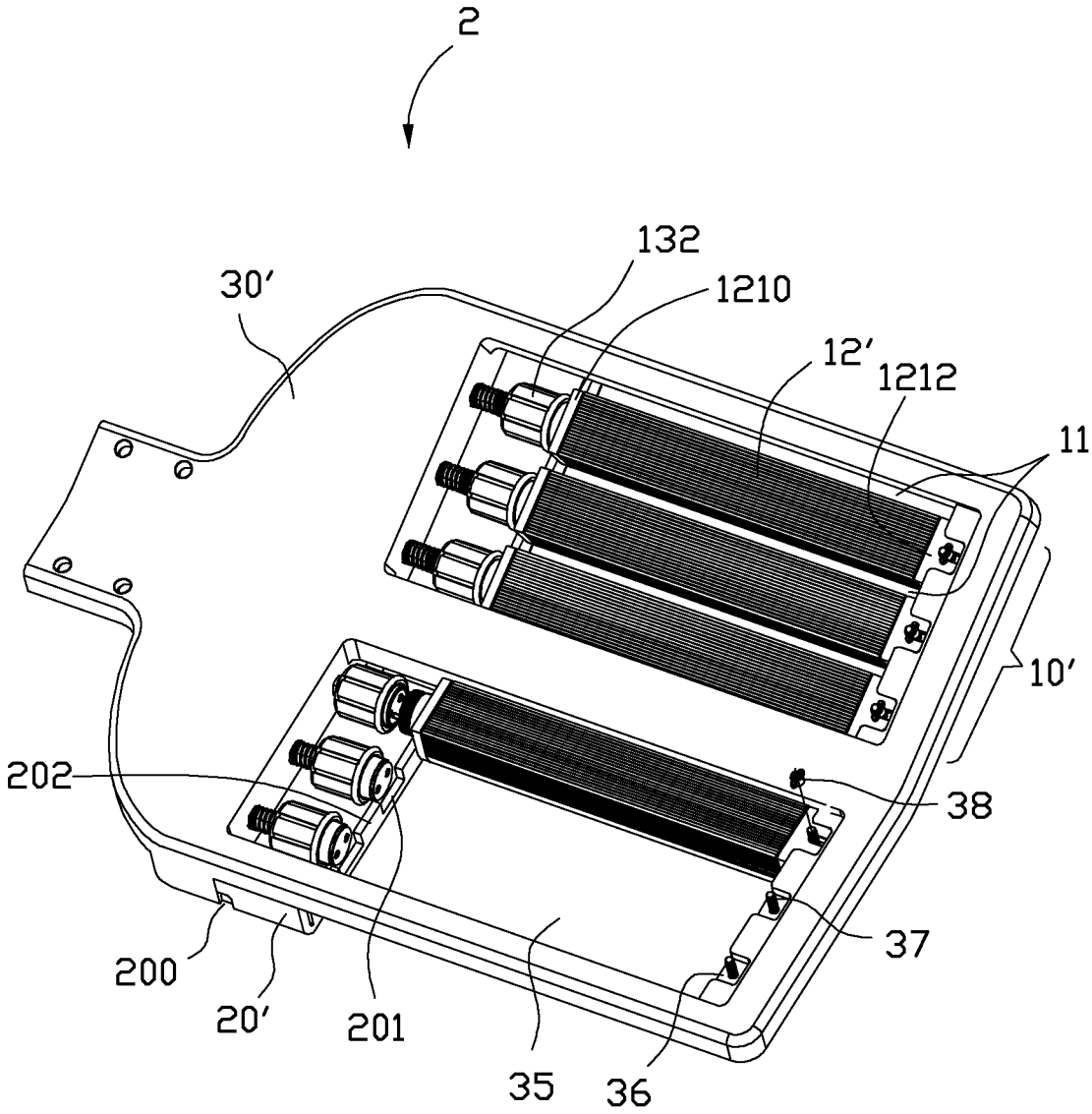
FIG. 8 is similar to FIG. 7, but viewed from another aspect, in which two illumination units are removed.

FIG. 7 through FIG. 12 illustrate an LED lamp 2 according to a second embodiment of the present disclosure. As shown in FIG. 7 and FIG. 8, the main difference between the LED lamp 1 and the LED lamp 2 is that the connection units 121 of the LED lamp 1 are replaced by connection units 1210 and connection units 1212 of the LED lamp 2. All power is supplied from the connection units 1210. The connection units 1212 provide mechanical connections for the illumination unit 12', not electrical connections. Thus, only six lamp holders 132 are needed to cooperated with the six connection units 1210 at one side of the two illumination modules 10'; numbers of the wire chute 34 and the mounting plates 20' can also be half of the first embodiment; the power cords 13*a* only connect to the nearby terminals of the illumination unit 12'; and the wire housing 231 of the LED lamp 2 is shorter than the wire housing 31 of the LED lamp 1.

All the power cords 13*a* now extend to the same side of the two wire chutes 34. The power cords 13*a* stored in the same wire chute 34 can be electrically connected to currents with different polarities. Currents with different polarities are separated by the lamp holders 132, so currents flow from p-type material to n-type material in LEDs.

The structures to fix the terminals of the illumination modules 10' are also changed. Each mounting plate 20' now further includes an end wall 202 adjacent the illumination units 12', and each end wall 202 defines three depressions 201 to support the three illumination units 12'. The lamp base 30' further defines six location caves 36, and the LED lamp 2 further includes six threaded bolts 37 and six nuts 38, such as wing nuts, corresponding to the six location caves 36. One end of each illumination units 12' is fixed on the lamp base 30 by one of the threaded bolts 37 respectively penetrating the connection unit 1212 and the location cave 36, and one of the nuts 38 is respectively screwed on the threaded bolt 37. The location caves 36 and the depressions 201 can effectively protect the illumination units 12' from being blown down by wind during assembly periods and disassembly periods in the air. Since the illumination units 12' can only be disassembled from top of the LED lamp 2 in this embodiment, falling probability of the illumination units 12' are effectively decreased, and safety of the LED lamp 2 is enhanced.

Figure 9:
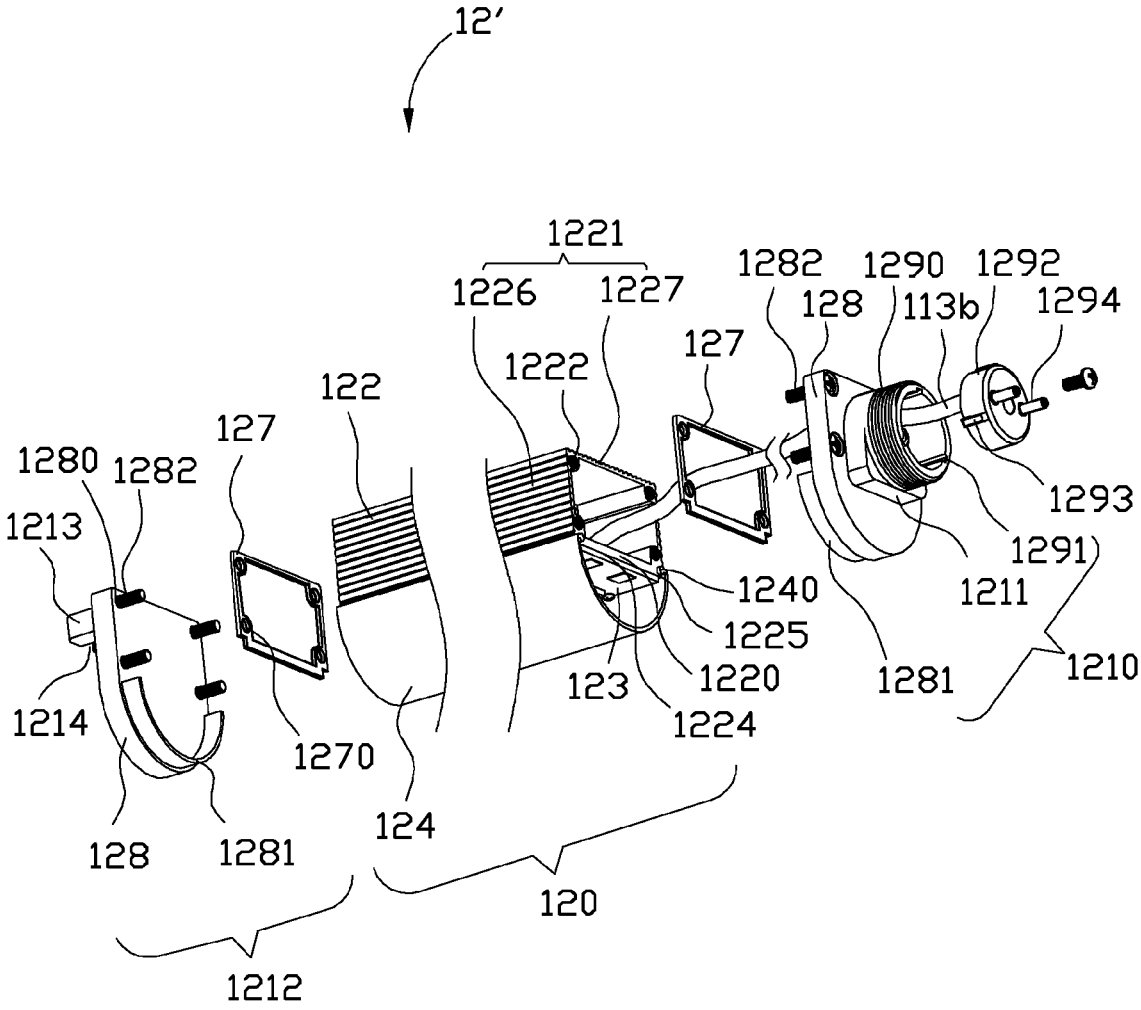
FIG. 9 shows a partially exploded view of an illumination unit of FIG. 7.

As shown in FIG. 9, the illumination unit 12' only includes one power cord 113*b* penetrating the lamp module 120 from the connection unit 1210 to replace the two power cord 13*b* of the illumination unit 12. The two contact pins 1294 are electrically connected to currents with different polarities respectively, and the power cord 113*b* includes different wires therein to individually transmit the currents to the electrode (not shown) of the printed circuit board 123. The lamp module 120 in this embodiment is identical with the lamp module 120 in the first embodiment.

The connection unit 1212 further includes an U-shaped protrusion portion 1213 located on the outer side of the cover 128 opposite to the lamp module 120. The U-shaped protrusion portion 1213 defines an opening 1214 for fastening to the lamp base 30'. Each illumination units 12' is fixed on the lamp base 30 of FIG. 8 by one of the threaded bolts 37 respectively penetrating the opening 1214 of the connection unit 1212 and the location cave 36. The difference between the connection unit 121 of the LED lamp 1 and the connection unit 1212 of the LED lamp 2 is that the connection unit 1212 does not include a lamp plug 1292, and the cover 128 of the connection unit 1212 does not define a wire hole 1284.

The difference between the connection unit 121 of the LED lamp 1 and the connection unit 1210 of the LED lamp 2 is that the stair portion 1283 of the connection unit 121 is replaced by a protrusion portion 1211 of the connection unit 1210. The protrusion portion 1211 engages with the depression 201 of FIG. 8, so the mounting plates 20' can stably hold the illumination units 12'.

Figure 10:
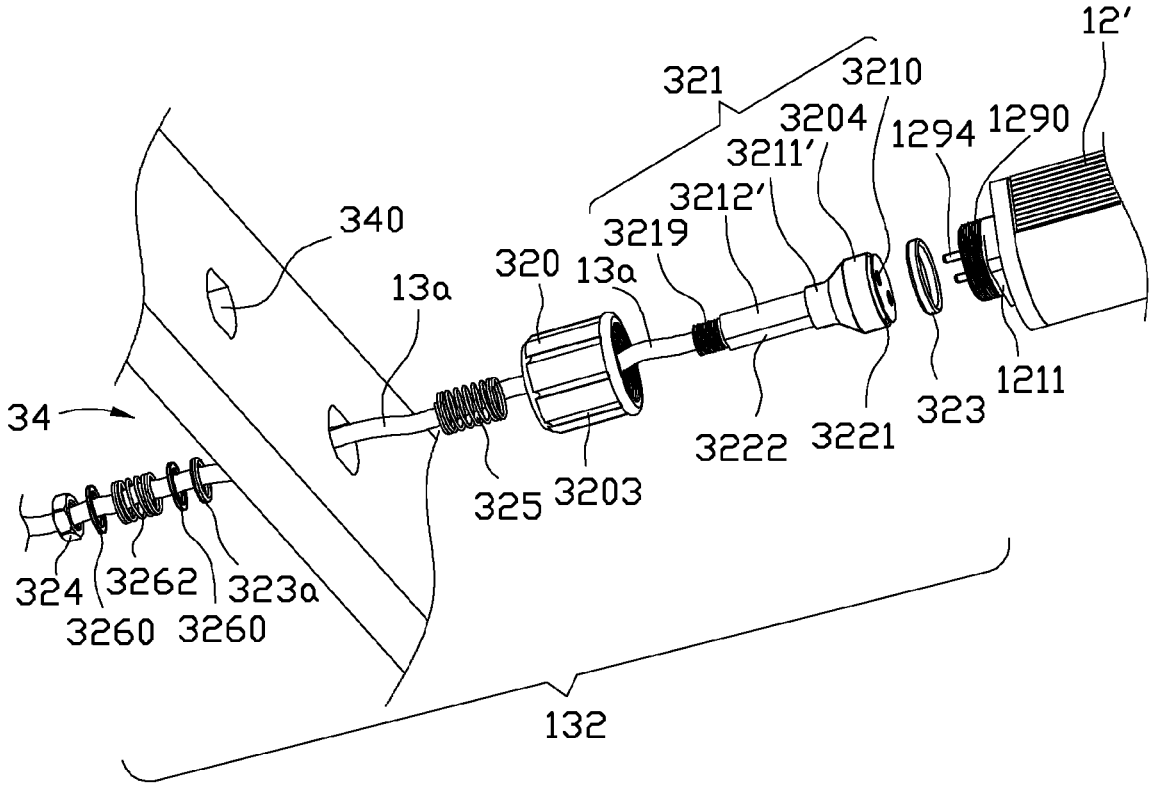
FIG. 10 is an exploded, isometric view of a lamp holder and a corresponding illumination unit of FIG. 7.

Referring to FIG. 10, the lamp holder 132 of the LED lamp 2 includes five differences from the lamp holder 32. First, the socket clips 3213 of the LED lamp 1 are replaced by socket holes 3210 fittingly engaging with the shape of the contact pins 1294. The two socket holes 3210 are electrically connected to currents with different polarities respectively. Secondly, the seal ring 322 of the LED lamp 1 is not needed. Thirdly, the socket base 3204 defines a seal groove 3221 to fit the seal ring 323. Fourthly, the neck portion 3211' of the lamp holder 132 is shorter than the neck portion 3211 of the lamp holder 32, and the orientation portion 3212' is longer than the orientation portion 3212. Fifthly, the lamp holder 132 further includes a first spring 325 located between the neck portion 3211' and the wire chute 34, a second spring 3262 located between the nut 324 and the wire chute 34, and two pads 3260 located on two opposite terminals of the second spring 3262.

As shown in FIG. 10, the method for assembling the lamp holder 132 to the lamp base 30' includes threading through the first spring 325 and the holding base 320 by the power cord 13*a* from the right to the left, pushing the first spring 325 and the holding base 320 onto the outer surface of the orientation portion 3212', threading through the location hole 340 of the wire chute 34 by the power cord 13*a*, pushing the orientation portion 3212' to insert into the location hole 340, threading through the seal ring 323*a*, one of the pads 3260, the second spring 3262, the other pad 3260 and the nut 324 by the power cord 13*a* inside the wire chute 34, pushing the seal ring 323*a*, the pads 3260 and the second spring 3262 onto the outer surface of the orientation portion 3212' inside the wire chute 34, screwing the nut 324 onto the threaded portion 3219, and fixing the mounting plates 20' to the lamp base 30' with the screws 1282 shown in FIG. 7. Accordingly, the second spring 3262 pushes the seal ring 323*a* to seal the location hole 340, and the lamp holder 132 is fixed to the wire chute 34. The lamp holder 132 can also be easily disassembled from the lamp base 30' without tools through back-stepping.

Figure 11:
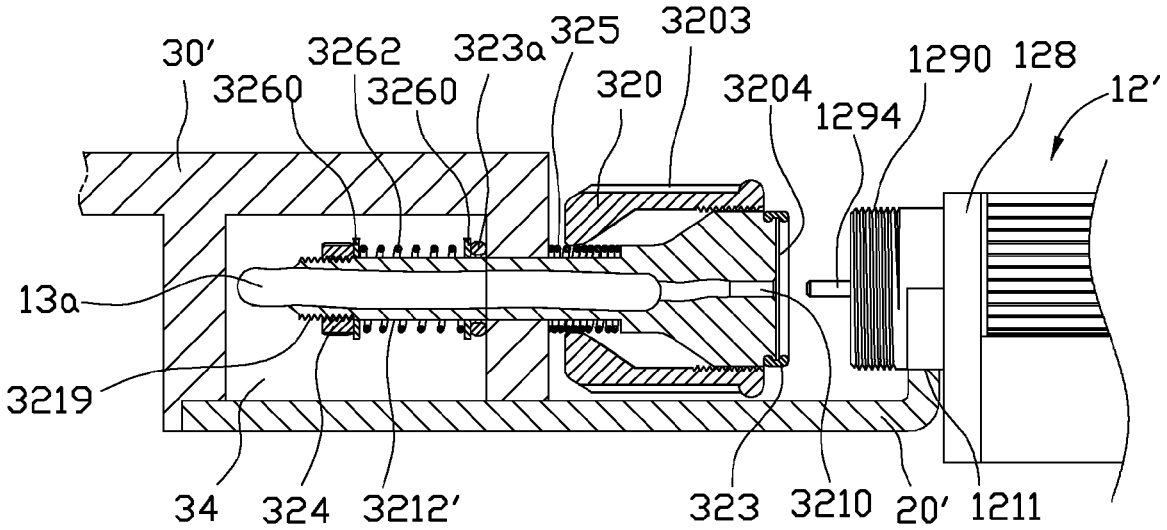
FIG. 11 is a cross sectional view illustrating an assembling step of an illumination unit to a lamp base of FIG. 7.
Figure 12:
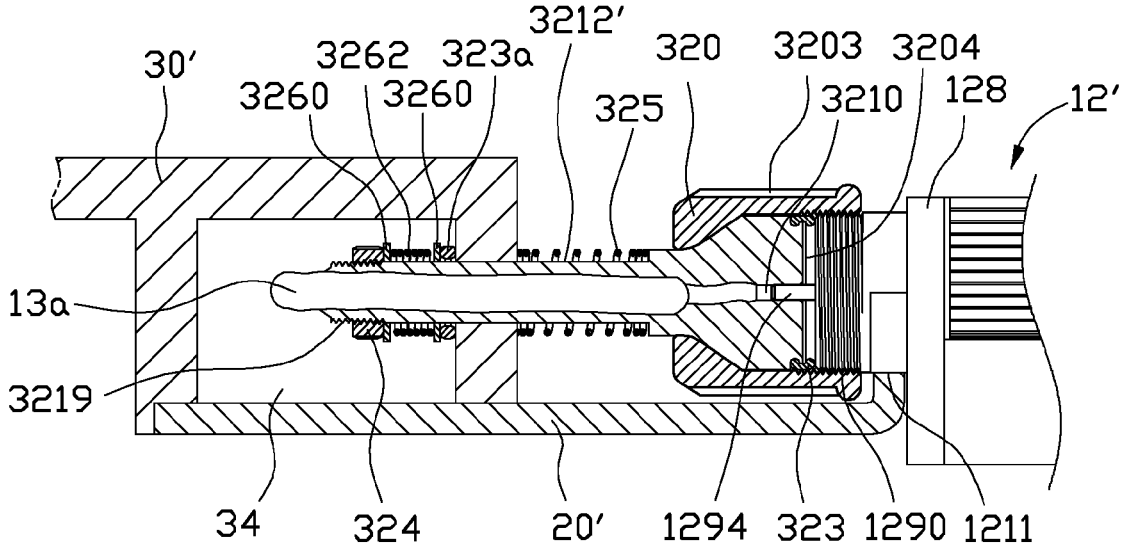
FIG. 12 is a view similar to FIG. 11, showing the illumination unit and the lamp base assembled together.

Assembly of the illumination unit 12' to the lamp holder 132 can be manually performed without tools before the LED lamp 2 is set up at the work field, such as a street, or the assembly and disassembly can be manually performed in the air after the LED lamp 2 is set up at the work field. Referring to FIG. 11 and FIG. 12, the method for assembling the illumination unit 12' to the lamp holder 132 includes the following steps. Firstly, using one finger gently pushes the end surface of the socket base 3204 toward the wire chute 34 to compress the first spring 325 until the holding base 320 close to the wire chute 34. Even though most portions of the orientation portion 3212' are moved into the wire chute 34, the accordingly released second spring 3262 still pushes the seal ring 323*a* to seal the location hole 340. Then, the illumination unit 12' is posited to the openings 35 of the lamp base 30' from top of the LED lamp 2, as shown in FIG. 8. The protrusion portion 1211 and the U-shaped protrusion portion 1213 of the illumination unit 12' respectively engage with the depression 201 of the mounting plates 20' and the location caves 36. The two contact pins 1294 located on one terminal of the illumination unit 12' correspond to and apart form the two socket holes 3210 of the lamp holder 132. Next, the socket base 3204 is released, so the first spring 325 pushes the approaching socket holes 3210 to fittingly engage with the contact pins 1294 spontaneously.

As shown in FIG. 12, the holding base 320 is next screwed onto the threaded neck 1290 by manually rotating the groove 3203 of the holding base 320. The outer threads of each threaded neck 1290 threadedly engage with the inner threads of the corresponding lamp holder 132, so as to enable maximum electrical contacting area between the socket holes 3210 and the contact pins 1294. Accordingly, one end of the seal ring 323, which protrudes from the end surface of the socket base 3204, tightly leans against the end surface of the threaded neck 1290 to seal the connection between the lamp holder 132 and the illumination unit 12'.

After the holding base 320 is screwed onto the threaded neck 1290, the first spring 325 pushes the socket base 3204 and therefore pulls most portions of the orientation portion 3212' out from the wire chute 34. As such, the second spring 3262 pushes the seal ring 323*a* to tightly seal the location hole 340. The first spring 325 and the second spring 3262 allow the long orientation portion 3212' straightly moving along the axis direction of the location hole 340. No matter the illumination unit 12' is unassembled from the lamp holder 132 in FIG. 11 or assembled to the lamp holder 132 in FIG. 12, one of the first spring 325 and the second spring 3262 is released, and the other is tensed. Accordingly, wherever the orientation portion 3212' moves to and fro, the second spring 3262 keep the seal ring 323*a* to seal the location hole 340. Thus, once the illumination unit 12' is assembled to the lamp holder 132, connection between the illumination unit 12' and the lamp holder 132, and connection between the wire chute 34 and the lamp holder 132 are both sealed to protect the electronic portions.

Thereafter, the threaded bolt 37 penetrates the opening 1214 of the connection unit 1212 and the location cave 36, and the nut 38 is screwed on the threaded bolt 37, as shown in FIG. 8. Disassembly of the illumination unit 12' from the lamp holder 132 is performed through back-stepping. By means of the above-mentioned steps, all the illumination units 12' can be easily and manually assembled to the corresponding lamp holders 132 of the lamp base 30' to provide functions of orientation, fastening, support, seal and electrical connection. Accordingly, the LED lamp 2 of the present disclosure is safe, weatherproof, convenient and protected.

Any of the above-mentioned electrical connections can be changed as required. For example, any of the lamp plugs 1292 can be replaced by at least one socket 321, and any of the sockets 321 can be replaced by at least one lamp plug 1292. In another embodiment, one illumination unit 12 or 12' may include both a lamp plug 1292 and a socket 321 located on two terminals thereof to connected to corresponding socket 321 and a lamp plug 1292 of the lamp holder 132.

The illumination units 12 and 12' integrate electrics, optics, and heat dissipation, and can operate individually. The sizes, numbers, shapes and arrangements of the illumination modules 10 and 10', the lamp base 30 and 30', the illumination units 12 and 12' and the openings 35 are not limited by this embodiment, and can be adjusted as required for different applications.

Accordingly, the present disclosure includes the following advantages:

First, the LED lamp of the present disclosure can be easily modified because of the use of the modularized illumination units. The illumination units integrate electrics, optics and heat dissipation, and can operate individually. The different numbers, sizes, arrangements and shapes of the illumination modules, the lamp holders, the lamp base, the illumination units and the openings can be recombined. Thus, various applications and customer needs can be easily achieved. The manufacture of the LED lamps is simplified, and the cost can be effectively reduced.

Secondly, the LED lamp of the present disclosure provides great thermal efficiency. The hollow heat dissipating assembly has a large heat absorbing area and a large dissipating area, and the gaps between the illumination units enhance natural convection. As such, illuminating efficiency and light weight of the LED lamp are ensured, and lifetime of the LED lamp is increased.

Thirdly, the LED lamp of the present disclosure reduces the cost of disassembly and repair. The lamp holders enable easier manual repair of the suspended illumination units. Repairmen can quickly replace the illuminating unit without tools. Accordingly, the LED lamp provides better maintenance quality, assembly convenience, and disassembly convenience.

Fourthly, the present disclosure provides an outdoor LED lamp with excellent weatherability. The LED lamp is protected from rain, humidity, dust, sunshine. The snow load, the drag coefficient, the amount of dust and sand deposition are reduced. Thus, safety and reliability are enhanced.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A light emitting diode (LED) lamp, comprising:

a lamp base, the lamp base defining a plurality of openings; and a plurality of illumination modules located on the lamp base and corresponding to the plurality of openings, each of the plurality of illumination modules comprising:

a plurality of lamp holders separately located on at least one sidewall of the plurality of openings; and a plurality of illumination units held by the plurality of lamp holders and apart from each other, each of the plurality of illumination units comprising:

a hollow heat dissipating assembly;

at least one lighting assembly contacting the hollow heat dissipating assembly whereby heat generated by the at least one lighting assembly is absorbed by the hollow heat dissipating assembly;

two connection units connected to the two opposite terminals of the hollow heat dissipating assembly; and at least one printed circuit board electrically connected to the at least one lighting assembly, wherein the at least one printed circuit board controls a power supply through the plurality of lamp holders and at least one of the two connection units to the at least one lighting assembly.

2. The LED lamp of claim 1, further comprising a plurality of first power cords electrically connected to the plurality of illumination units.

3. The LED lamp of claim 2, wherein the lamp base further defines a plurality of wire chutes located at least one of the two terminals of the plurality of illumination modules to store the plurality of first power cords.

4. The LED lamp of claim 3, wherein some of the plurality of first power cords connected to one of the two terminals of the illumination modules are electrically connected to a current with a first polarity, and other of the plurality of first power cords connected to the opposite terminals of the illumination modules are electrically connected to a current with a different polarity.

5. The LED lamp of claim 3, wherein all the plurality of first power cords are connected to one of the two terminals of the illumination modules, and are electrically connected to currents with different polarities.

6. The LED lamp of claim 3, wherein each of the plurality of illumination modules further comprises a plurality of mounting plates respectively covering the plurality of wire chutes and the plurality of lamp holders.

7. The LED lamp of claim 6, wherein the LED lamp further defines a plurality of drainage pipelines between the plurality of mounting plates and the plurality of wire chutes to drain water from the LED lamp.

8. The LED lamp of claim 6, wherein each of the plurality of mounting plates further includes an end wall adjacent the plurality of illumination units.

9. The LED lamp of claim 8, wherein each of the plurality of end walls defines a plurality of depressions to hold the plurality of illumination units respectively.

10. The LED lamp of claim 1, wherein each of the two connection units comprises a cover, a seal piece, and a lamp plug.

11. The LED lamp of claim 10, wherein each of the plurality of illumination units comprises a lamp module, and the lamp module comprises the hollow heat dissipating assembly and the at least one lighting assembly.

12. The LED lamp of claim 11, wherein the cover comprises:

a location piece inserted into the lamp module;

a stair portion located on an outer side of the cover opposite to the at least one lighting assembly;

a threaded neck substantially a cylinder extending outwardly from the cover opposite to the at least one lighting assembly; and a wire hole.

13. The LED lamp of claim 1, wherein each of the plurality of lamp holders comprises a holding base, a socket, a nut, and a number of seal rings.

14. The LED lamp of claim 13, wherein one of the plurality of first power cords penetrates the nut, one of the plurality of seal rings, one of the plurality of wire chutes, the holding base, and one of the plurality of seal rings, and inserts into the socket from the left to the right.

15. The LED lamp of claim 13, wherein the socket comprises two socket clips, and each of the two socket clip defines two hooked fasteners, two sidewalls, two expansion portions to hold two contact pins of the lamp plug, and a weld portion from top to bottom.

16. The LED lamp of claim 13, wherein the socket comprises two socket holes to fit two contact pins of the lamp plug.

17. The LED lamp of claim 13, wherein the socket comprises a socket base, a neck portion connected to the socket base, an orientation portion connected to the neck portion, and a threaded portion connected to the orientation portion.

18. The LED lamp of claim 17, wherein each of the plurality of lamp holders further comprises:

a first spring located between the neck portion and one of the plurality of wire chutes;

a second spring located between the nut and the one of the plurality of wire chutes; and two pads located on two opposite terminals of the second spring.

* * * * *